United States Patent [19]

Duggins et al.

[11] 4,121,343

[45] Oct. 24, 1978

[54] PICTURE FRAME MAT OPENING MARKER

[75] Inventors: Richard Wayne Duggins, Hillsborough; James William Rodgers, Durham, both of N.C.

[73] Assignee: Frameworks, Inc., Hillsborough, N.C.

[21] Appl. No.: 810,775

[22] Filed: Jun. 28, 1977

[51] Int. Cl.[2] ..... B43L 13/02

[52] U.S. Cl. ..... 33/42; 33/108

[58] Field of Search ..... 33/40, 42, 43, 44, 108, 33/110

[56] References Cited

U.S. PATENT DOCUMENTS

| | | | |
|---|---|---|---|
| 778,521 | 12/1904 | Wheat | 33/42 |
| 950,696 | 3/1910 | Herman | 33/108 |
| 2,322,277 | 6/1943 | Brown | 33/42 |
| 2,513,404 | 7/1950 | Di Maria | 33/108 |
| 3,104,467 | 9/1963 | Llyod-Young | 33/42 |

*Primary Examiner*—Richard E. Aegerter
*Assistant Examiner*—John W. Shepperd
*Attorney, Agent, or Firm*—B. B. Olive

[57] ABSTRACT

A mat opening marking device is provided for laying out full line rectangular openings to be cut in picture frame mat material, and the like. A thin, transparent plate member on one side mounts a straight edge member which can be adjusted to various parallel positions to engage an outer edge of the mat material and on an opposite side mounts a marking device support member having a replaceable marking device whose marking point can be arranged to extend through any one of a series of arcuately arranged selected openings in the plate member to engage and mark the four sides of the mat surface opening along the four outer edges of the mat and at predetermined distances inward therefrom.

4 Claims, 8 Drawing Figures

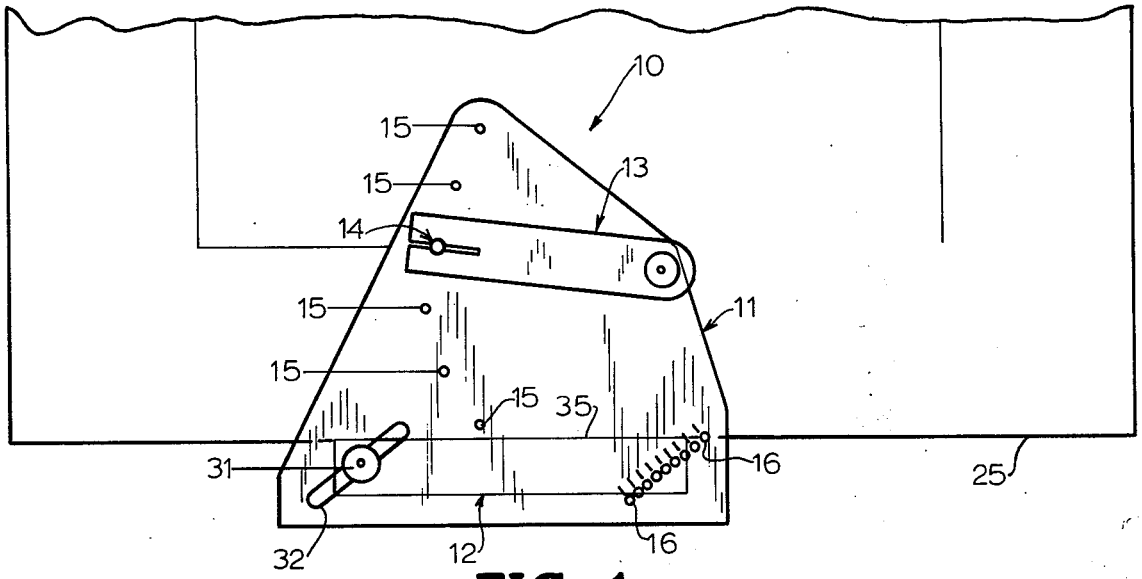
FIG. 1
FIG. 6
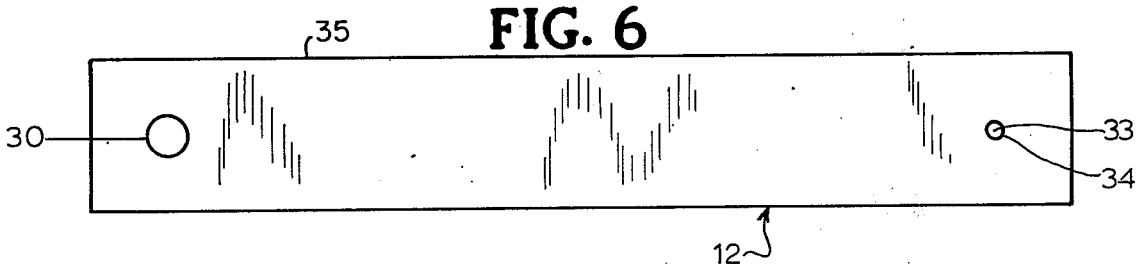
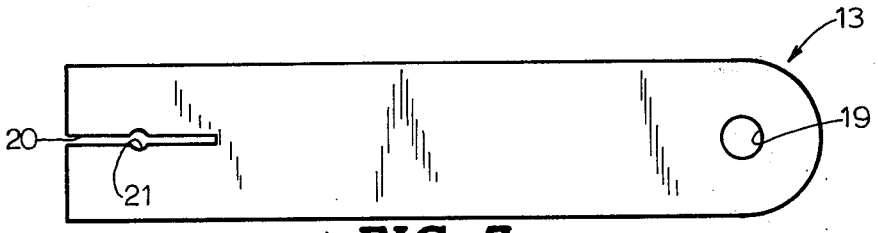
FIG. 7
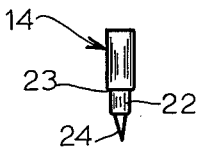
FIG. 8

PICTURE FRAME MAT OPENING MARKER

BACKGROUND OF THE INVENTION

1. Field of the Invention

The picture frame mat opening marking device of the present invention relates to means for rapidly outlining in full a rectangular opening for a mat to be used in framing a picture, or the like.

2. Description of the Prior Art

Various forms of complex and expensive templates, rulers and guides have been offered to individuals for marking openings in mat material but to applicant's knowledge, no device of this type has been offered which has been acceptable for a wide range of mat sizes and which is economical in price and easy to set and adjust.

SUMMARY OF THE INVENTION

According to the present invention, there is provided an adjustable picture frame mat opening marking device comprising a thin transparent plate member with an array of predetermined holes and appropriate inch and fractional inch markings, a thin transparent straight edge guide member adjustably mounted on one side of the plate member, an adjustable thin arm marking device support member and a lead marking holder removably mounted on the opposite side of the support member so that the marking point can be made to extend through any one of a series of arcuately arranged selected openings in the plate member to engage and mark the four sides of the mat surface opening along the four outer edges of the mat. The desired mat border dimensions are set on the mat marking device by adjusting the guide member and the arm support member to the appropriate hole settings. The picture frame mat opening marker disclosed is adjustable from a maximum of 6 inches to a minimum of ⅛ inch by ⅛ inch intervals. It is contemplated that smaller increments or a greater maximum could be used but which would fall under the scope of the present invention.

DESCRIPTION OF THE DRAWINGS

FIG. 1 is a plan view of the picture frame mat opening marker of the present invention absent the indicia to conserve space. The device is shown in operation with the markings being represented by light lines.

FIG. 6 is an enlarged plan view of the thin transparent straight edge guide member employed in the present invention.

FIG. 7 is an enlarged plan view of the thin arm lead holder member employed in the present invention.

FIG. 8 is a side elevation view of the lead marking holder employed in the present invention.

DESCRIPTION OF THE PREFERRED EMBODIMENT

Figure 5:
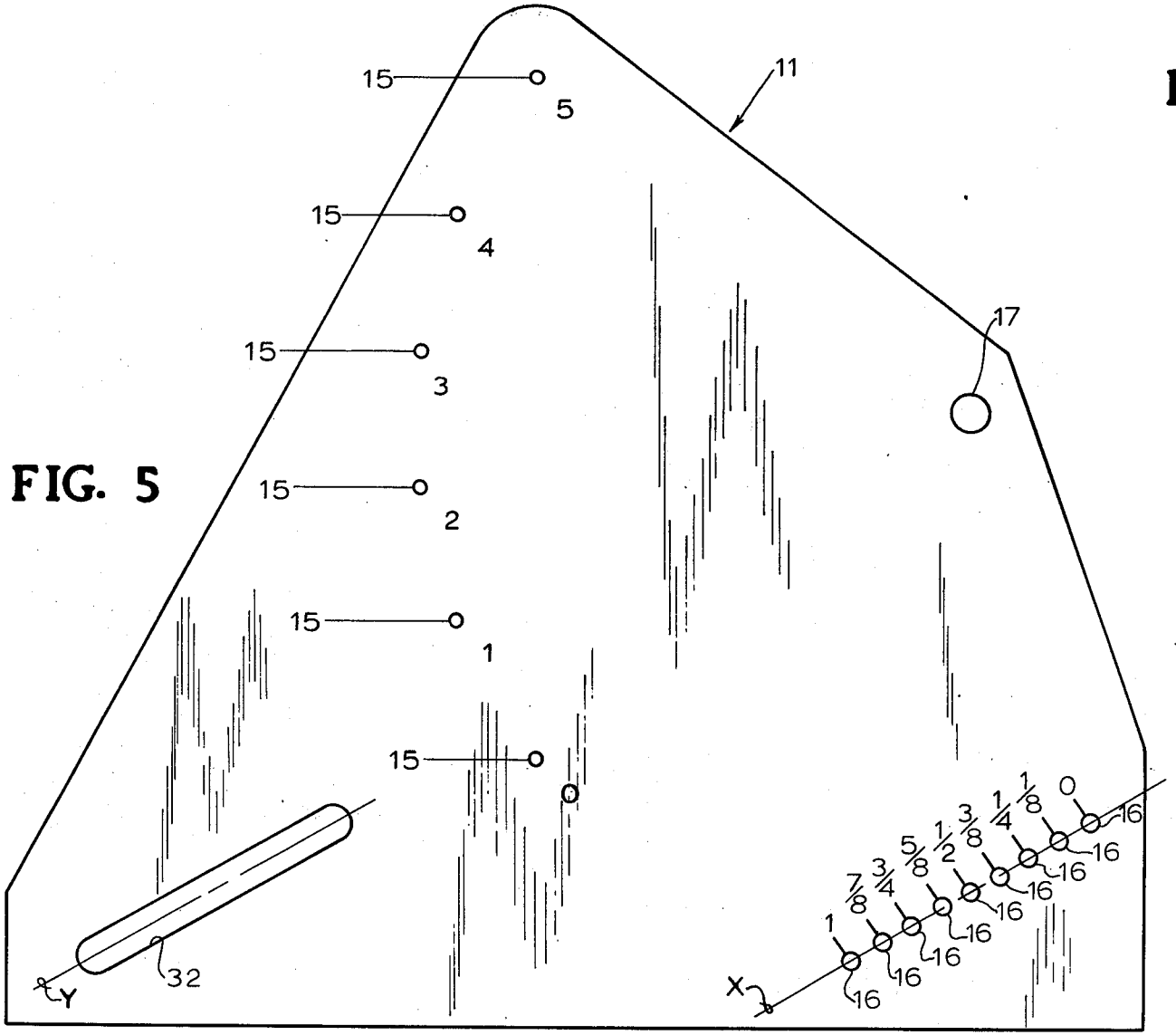
FIG. 5 is an enlarged plan view of the thin transparent plate member with the predetermined holes and appropriate markings imprinted thereon.

Referring now to FIG. 1, there is illustrated an adjustable picture frame mat opening marking assembly of the present invention as designated by the numeral 10. The mat opening marking assembly 10 is composed of a thin transparent plate member 11, a thin transparent straight edge guide member 12, a thin transparent arm member 13 and an interchangeable commercially available disposable lead marking holder 14. Plate member 11 has two sets of holes made therein at predetermined intervals. Holes 15 are arcuately arranged and extend through plate 11. Holes 15 are numbered 0 inch through 5 inches. Holes 16 are linearly and angularly arranged and extend through plate 11. Holes 16 are numbered 0 inch through 1 inch with intervals every ⅛ inch. The holes 16 are so arranged that an angled linear axis X extends through the center of each hole 16 (see FIG. 5). Hole 17 (FIG. 5) in plate member 11 is adapted to receive arm member 13 in a pivotal relation with press rivet 18 passing through hole 19 in an arm member 13 and through hole 17. Arm member 13 pivots about rivet 18 and slides on the face surface of plate member 11. A slot 20 in arm member 13 allows the walls of hole 21 in arm member 13 to be spread apart by using a screw driver tip, coin, or the like. Slot 20 is spread apart so that sleeve 22 of holder 14 can be placed therein and once in place the walls of hole 21 tightly grip sleeve 22 and retain it in a non-movable position. Ledge 23 of holder 14 rests flat against the top surface of arm member 13 when in position for marking. Sleeve 22 passes through any one of the arcuately arranged holes 15 depending upon the desired inch setting. Lead 24 passes through plate member 11 and rests on and marks upon mat material 25. Lead marking holder 14 and lead 24 are disposable by the spreading of slot 20 and a new holder 14 is inserted in hole 21. Any other type of disposable marking point, e.g., a ball point pen could be used instead.

Straight edge guide member 12 is also pivotal on plate member 11 but is mounted for pivotal and slidable movement on the back surface of plate 11 so as to have its mat engaging edge positionable at various parallel positions. Arm member 13 and guide member 12, as previously noted, are on opposed sides of plate member 11. Hole 30 in guide member 12 receives a press rivet 31 which passes through hole 30 and then through a slot 32 in member 11. Axis Y of slot 32 is in parallel alignment with axis X of holes 16 (see FIG. 5). Rivet 31 is allowed to move back and forth in slot 32 which, in turn, allows guide member 12 to slide back and forth on plate member 11 as rivet 31 slides in slot 32 and as a metal pin 33 is moved from one hole 16 to another. Metal pin 33 is rigidly secured in hole 34 of guide member 12 and is designed to fit snugly into one of holes 16 in plate member 11 at the desired setting. It is possible with this marker 10 to achieve mat marker settings of 6 inches maximum down to ⅛ inch minimum.

A rectangular mat opening marking operation is accomplished with mat marker 10 by choosing the desired settings for the desired mat opening dimension. The setting for marker 10 in FIG. 1 is for 3½ inches which is the set distance between the marking point 24 and the inner mat engaging edge of the guide-member 12. Once guide member 12 is set with pin 33 in hole 16 corresponding to ½ inch and sleeve 22 of holder 14 is placed in hole 15 corresponding to 3 inches, mat 25 can now be marked for an opening having a 3½ inch border. This marking is accomplished by placing edge 35 of guide member 12 against the outer edge of mat material 25 and sliding marking device 10 around the periphery of mat material 25. As this sliding is proceeding, lead 24 is marking the desired opening for a mat having a border of 3½ inches in width. The opening may now be cut out with an appropriate cutting tool. The mat opening borders have been marked with full lines and not just at the corners. This gives clear guide lines for cutting the entire opening from mat material 25.

Figure 3:
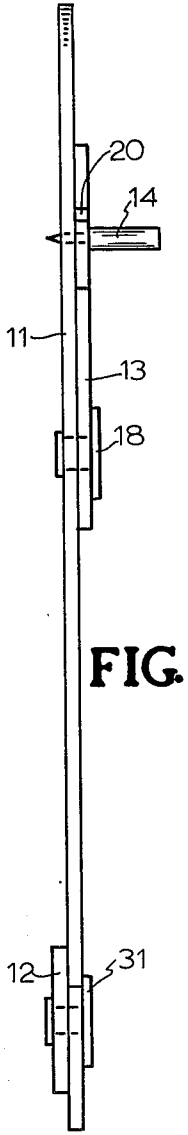
FIG. 3 is a left side elevation view of the marker of FIG. 2.
Figure 2:
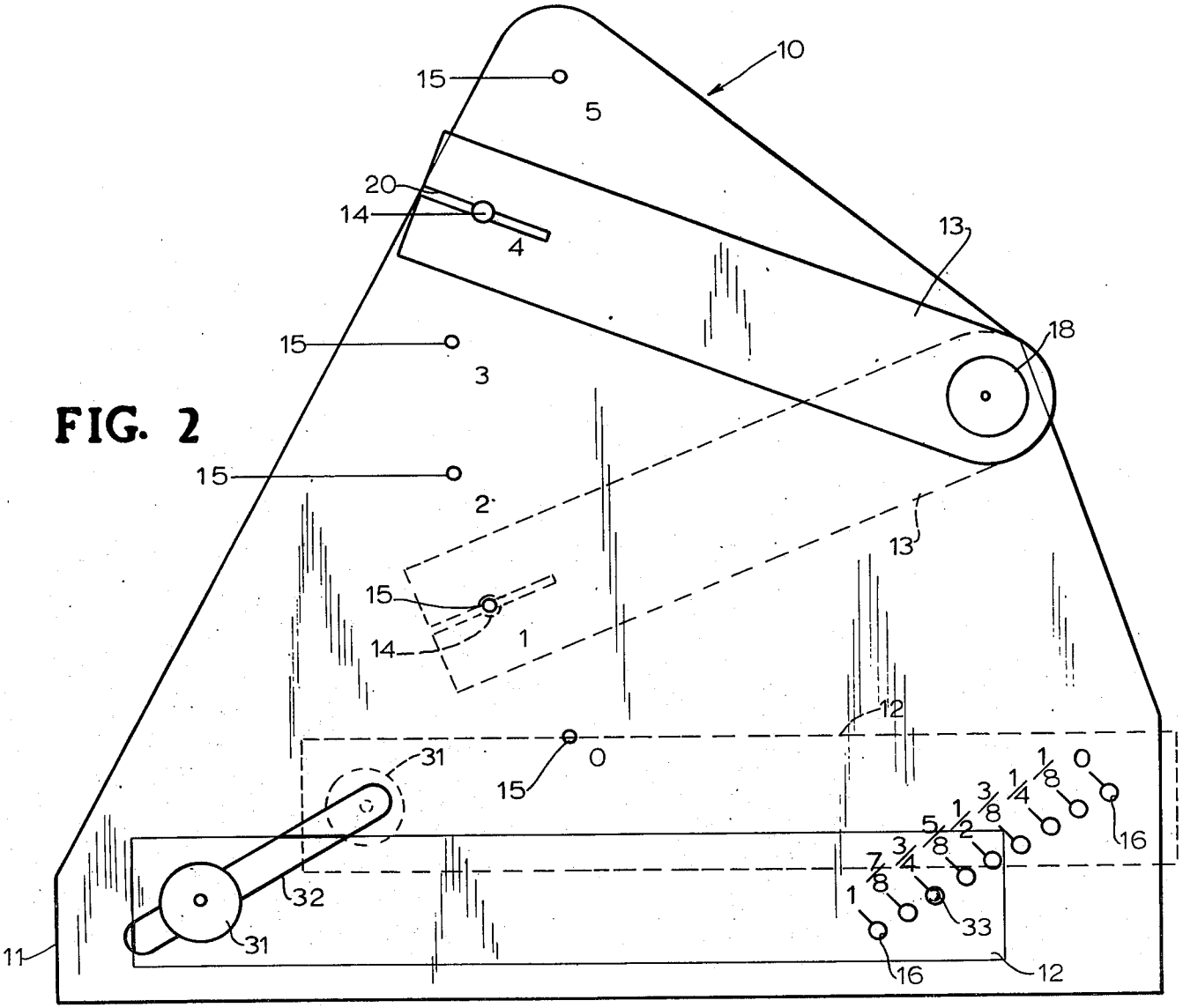
FIG. 2 is an enlarged plan view of the picture frame mat opening marker of the present invention with a mat border setting of 4¾ inches shown in solid lines and a mat border setting of 1 inch shown in dashed lines.
Figure 4:
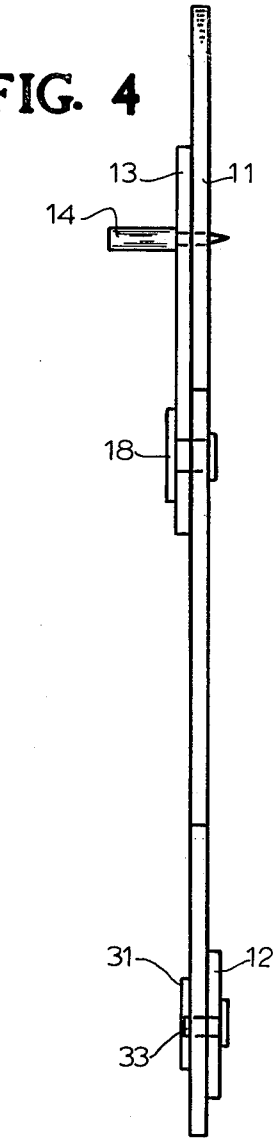
FIG. 4 is a right side elevation view of the marker of FIG. 2.

Referring back to FIG. 2, two other possible mat opening settings are illustrated. In solid lines, a setting of 4¾ inches is shown. In dashed lines, a setting of 1 inch is shown. As the inch dimension is changed, arm member 13 pivots about rivet 18 and as the fractional dimension is changed guide member 12 slides on member 11 with rivet 31 sliding in slot 32 and pin 33 is moved to the desired fractional inch setting. The maximum setting of 6 inches is achieved by placing pin 33 in hole 16 marked 1 inch and placing sleeve 22 in hole 15 marked 5 inches. The minimum setting of ⅛ inch is achieved by placing pin 33 in hole 16 marked ⅛ inch and placing sleeve 22 in hole 15 marked 0 inch.

Of particular value to utilization of the invention is the fact that the free ends of both the thin marking arm member 13 and the straight edge member 12 can be flexed slightly away from plate member 11 which allows ease of adjustment both of the lead point 24 and the pin 33 into their respective holes. While transparency of all members is preferred and the use of thin plastic sheet is a preferred construction material, other opaque materials such as sheet aluminum, or the like, could be employed.

What is claimed is:

1. An adjustable marking assembly for laying out openings to be cut in picture frame mats, said marking assembly comprising:

(a) a thin flat plate member having a first set of holes in arcuate arrangement, a second set of holes in an angled linearly aligned arrangement and identified by successive indicia of measurement, and an angled slot having its central linear axis parallel to the central linear axis of said angled holes;

(b) a first pivot means adjustably mounted for slidable movement in said angled slot;

(c) a thin straight edge member having one end thereof pivotally mounted on said first pivot means on the back surface of said plate member and the opposite end free and being adapted for both pivotal and slidably movement, the free end of said straight edge member including pin means adapted to engage any one of said angled linear arranged holes to secure the positioning desired;

(d) a second pivot means, said second pivot means mounted in said plate member and passing therethrough; and (e) a thin arm member having one end pivotally mounted on said second pivot means on the front surface of said plate member and means at an opposite free end thereof for detachably receiving and securing a disposable surface marking device, said surface marking device being adapted for engagement with and positioning into any one of said arcuately arranged holes.

2. The marking assembly of claim 1 wherein said plate, arm and straight edge members are all made of transparent material.

3. The marking assembly in accordance with claim 1 wherein said means in said arm member for receiving and securing said surface marking device comprises an elongated slot having an enlarged area for detachably receiving and engaging said surface marking device.

4. The marking assembly in accordance with claim 3 wherein said surface marking device consists of a disposable interchangeable lead marking holder having a sleeve member for engaging the walls of said elongated slot.

* * * * *